US005088512A

United States Patent [19]

Chou et al.

[11] Patent Number: 5,088,512

[45] Date of Patent: Feb. 18, 1992

[54] LIGHTLY OPERABLE FULLY AUTOMATIC UMBRELLA

[75] Inventors: Luc L. Chou; Jonathan C. Cheng, both of Taipei, Taiwan

[73] Assignee: Sheng-Tong Day, Taichung, Taiwan

[21] Appl. No.: 738,666

[22] Filed: Jul. 31, 1991

[51] Int. Cl.[5] ..... A45B 25/14

[52] U.S. Cl. ..... 135/24; 135/28; 135/41

[58] Field of Search ..... 135/22-24, 135/25.1, 28, 41, 39, 38, 42

[56] References Cited

U.S. PATENT DOCUMENTS

| | | | |
|---|---|---|---|
| 571,911 | 11/1896 | Stokes | 135/41 |
| 631,442 | 8/1899 | Rose | 135/41 |
| 3,672,382 | 6/1972 | Sato | 135/24 |
| 3,677,274 | 7/1972 | Yasuda et al. | 135/24 |
| 3,856,032 | 12/1974 | Schafer | 135/41 X |
| 4,534,374 | 8/1985 | Day | 135/24 X |
| 4,682,616 | 7/1987 | Schultes | 135/24 X |
| 4,802.499 | 2/1989 | Lisack | 135/24 |
| 4,989,625 | 2/1991 | Wu | 135/24 X |

FOREIGN PATENT DOCUMENTS

| | | | |
|---|---|---|---|
| 1242813 | 6/1967 | Fed. Rep. of Germany | 135/28 |
| 639131 | 5/1962 | Italy | 135/41 |
| 2347 | of 1862 | United Kingdom | 135/41 |
| 4324 | of 1897 | United Kingdom | 135/41 |
| 931810 | 7/1963 | United Kingdom | 135/28 |
| 1354482 | 5/1974 | United Kingdom | 135/41 |

*Primary Examiner*—David A. Scherbel
*Assistant Examiner*—Lan Mai

[57] ABSTRACT

A lightly operable fully automatic umbrella comprising a hollow shank having a reduced neck at intermediate portion to divide it into an upper section having upper and lower apertures and a lower section having upper and lower holes, a longitudinal guide groove at the upper section and a middle ring provided at a location having a distance from the top end, the guide groove having a through hole communicating with the interior of the shank; a cylinder mounted around the shank at the end section above the middle ring for receiving an umbrella opening spring therein, and provided with an upper ring at outer lower end; a slidable sleeve mounted around the shank at the upper section, having upper and lower pawls, and provided with a lower ring at outer upper end, including an inner sleeve having a slot; an inner shaft inserted in the lower section of the shank, having upper and lower holes, including an umbrella closing spring received in a space between the top end thereof and the reduced neck, a wire and a slide block, the upper end of the wire extending out of the through hole in the guide groove of the shank and hooking onto the inner sleeve; a handle with a grip, mounted outside of the lower section of the shank; and an actuating member disposed at lateral side of the handle, having upper and lower locking means for controlling the action of opening and closing the umbrella, respectively.

6 Claims, 3 Drawing Sheets

LIGHTLY OPERABLE FULLY AUTOMATIC UMBRELLA

FIELD OF THE INVENTION

This invention relates to an automatic umbrella, more particularly, to an umbrella which can be opened and closed automatically with light operation.

Conventionally, so called automatic umbrella can be only opened rather than closed automatically. The same applicant disclosed in his U.S. Pat. Nos. 4,534,374, 4,548,222 and 4,823,821 a series of automatic umbrellas which can be both opened and closed automatically, but due to the design of the constructions and the arrangements of the compression springs, an operating force required to open the umbrella is so big that any user is unable to operate with a single hand, hence the manufacture and sales of them have long been hesitated so far.

SUMMARY OF THE INVENTION

It is, therefore, an object of the present invention to obviate shortcomings of the conventional automatic umbrella previously discussed, and to provid a fully automatic umbrella which can be opened and closed lightly with a single hand by means of a single push button type actuating member.

This object is accomplished by a new technical thinking embodied with a novel arrangement of the compression springs according to the present invention, different from conventional ones in consideration of dynamic mechanism based on the principle of the equilibrium of moments.

In order to achieve this object, the present invention mainly provide a lightly operable fully automatic umbrella which comprises a hollow shank having a reduced neck at intermediate portion to divide it into an upper section having upper and lower apertures and a lower section having upper and lower holes, a longitudinal guide groove at said upper section and a middle ring provided at a location having a distance from the top end, said guide groove having a through hole communicating with the interior of said shank; a cylinder mounted around said shank at the end section above said middle ring for receiving an umbrella spring herein, and provided with an upper ring at outer lower end; a slidable sleeve mounted around said shank at said upper section, having upper and lower pawls, and provided with a lower ring at outer upper end, including an inner sleeve having a slot; an inner shaft inserted in said lower section of said shank, having upper and lower holes, including an umbrella closing spring received in a space between the top end thereof and said reduced neck, a wire and a slide block, the upper end of said wire extending out of said through hole in said guide groove of said shank and hooking onto said inner sleeve; a handle with a grip, mounted outside of said lower section of said shank; and an actuating member disposed at lateral side of said handle, having upper and lower locking means for controlling the action of opening and closing the umbrella, respectively.

The automatic umbrella according to the present invention can be operated by a relatively small force applied onto said umbrella closing spring due to the fact that said umbrella opening spring is disposed on the top end of said shank while said umbrella closing spring is positioned at the intermediate of said shank. Moreover, said umbrella opening spring is maintained in a compressed, energy accumlated position when the umbrella is kept in the closing state before opening, whereas said umbrella closing spring is also maintained in a compressed, energy accumulated position when the umbrella is kept in the opening state before closing. Therefore, as soon as the actuating member is operated, the umbrella opening or closing spring will be responded immediately to proceed fast and positive operation.

BRIEF DESCRIPTION OF THE DRAWINGS

The foregoing and other objects, features and advantages of the invention will be apparent from the following particular description of preferred embodiments of the invention as illustrated in the accompanying drawings, in which.

DETAILED DESCRIPTION OF PREFERRED EMBODIMENT

Figure 1:
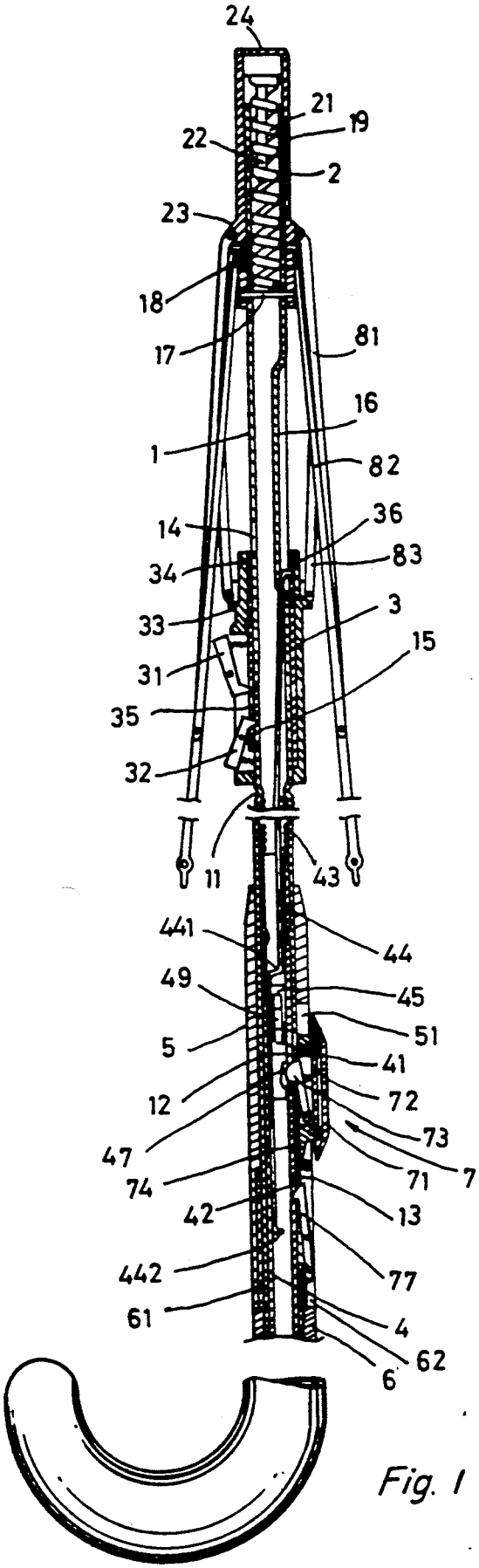
FIG. 1 is a partly sectional elevation illustrating the automatic umbrella of the invention in the closing and preparative state before opening.

Now, reference is made to FIG. 1 which shows that the present invention mainly comprises a shank 1, a cylinder 2, a slidable sleeve 3, an inner shaft 4, a handle 5 with a grip 6, and an actuating member 7.

The shank 1 is made of a hollow tube and formed with a reduced neck 11 at almost intermdiate portion. The neck 11 divides said shank 1 into two sections, i.e. the lower section having an upper hole 12 and a lower hole 13 and the upper section having an upper aperture 14 and a lower aperture 15. At another side of the shank 1 there is a longitudinal guide groove 16 having a through hole communicating with the interior of said shank 1. A pin 17 is passed through the shank 1 to secure a middle ring 18 thereon at a distance from the top end.

The cylinder 2 is mounted around the end section 19 of said shank 1 above said middle ring 18 and has a length greater than said end section 19. An umbrella opening spring 21 is disposed around a guide pin 22 within said cylinder 2 and extended into said end section 19 of the shank 1 and terminated at said pin 17. In response to the compression and expansion of said umbrella opening spring 21, said end section 19 is retractably moved within said cylinder 2. The cylinder 2 is provided with an upper ring 23 at outside lower portion. The top end 24 of said cylinder 2 is the utmost top end of whole umbrella.

The slidable sleeve 3 is mounted around the upper section of said shank 1 and displaceable between said neck 11 and said middle ring 18. An upper pawl 31 and a lower pawl 32 are biased inwardly by respective spring as shown. A lower ring 33 is formed at outside upper portion. An inner sleeve 34 is sandwiched between said sleeve 3 and said shank 1 and has a slot 35 at one side and a notch 36 at upper end. The inner sleeve 34 is slidable together with said slidable sleeve 3. In the illustrated closing state of the umbrella, said slot 35 is aligned with said lower aperture 15, so that said lower pawl 32 is engaged thereinto to make said slidable sleeve 3 secured at lower position in form of closing state of the umbrella.

The inner shaft 4 is inserted into the lower section of said shank, and has an upper hole 41 and a lower hole 42. An umbrella closing spring 43 is received between the top end of said inner shaft 4 and said neck 11 of the shank 1. Inside of said inner shaft 4 there are a wire 44 and a slide block 45. The hooked top end of said wire 44 is extended out of the shank 1 through the mentioned hole that communicated between said guide groove 16 and the interior of said shank 1, and hooked into said notch 35 of said inner sleeve 34 such that may be slided along the guide groove 16 of said shank 1. The wire 44 is deflected at lower section and partly inserted into the channel 46 of said block 45, as additionally referred to FIG. 2. The wire 44 is formed with a step 441 at deflection and a hook 442 at lower end. Said block 45 is formed with a recess 47 at lower section and a lateral trough 48 at upper section. A deflected leaf spring 49 is restricted at both ends of said trough 48 so as to make the central deflection of said spring 49 protruded against the inside wall of said inner shaft 4, as the positioning means to prevent said block 45 from undesirable displacement within said shaft 4.

Figure 2:
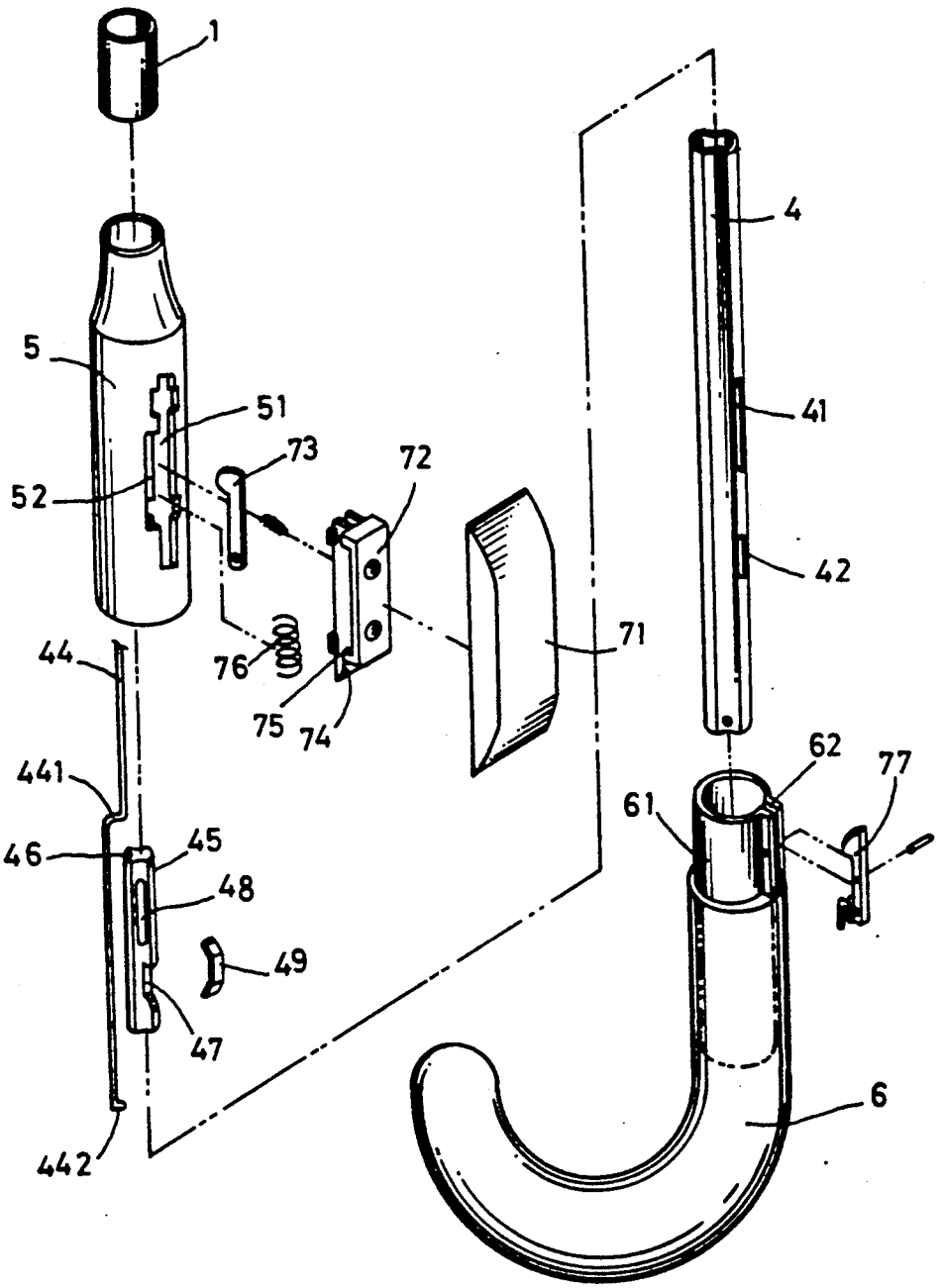
FIG. 2 is an exploded perspective view illustrating the lower section of the shank including the handle and the grip.

As best shown in FIG. 2, the handle 5 is in a shape of cylindrical tube with frustrated conical top portion and mounted outside of the lower section of said shank 1. Said handle 5 has a slot 51 which is formed with a lateral shoulder 52. The handle 5 is engaged at lower end with a grip 6. Said grip 6 is integrally or additionally provided with a connection 61 which is formed with a slot 62 at one side.

The actuating member 7 disposed at one side of said handle 5 includes a push button 71 and an actuator 72 engaged thereunder. The latter includes an upper locking means 73 biased inwardly and a taper portion 74, and is entirely received into said slot 51 of the handle. The actuator 72 is formed with a lateral shoulder 75 combining with the shoulder 52 of said slot 51 to form a space sufficient to contain a return spring 76. This spring 76 will make the push button 71 along with the actuator 72 returned to intermediate position after it is either pushed upwards to open or downward to close the umbrella. A lower locking means 77 is disposed in the slot 62 of said grip 6 at a location just below said taper portion 74 of said actuator 72.

The frame of the present umbrella, as conventiona one, includes a plurality of ribs 81, spreaders 82 and supports 83. Each rib 81 is at one end pivotably connected to said upper ring 23 and at other end free. Each spreader 82 is at one end pivotably mounted at intermediate of corresponding rib 81. And each support 83 is at one end pivotably connected to said lower ring 33 and at other end pivotably supporting to corresponding spreader 82 at intermediate.

With the construction mentioned above, the present automatic umbrella in the closing and preparative state before opening is substantially illustrated in FIG. 1. The umbrella opening spring 21 is compressed to become an energy accumulated state during the preceeding action of closing the umbrella. At this state, since the slot 35 of the inner sleeve 34 is aligned with the lower aperture 15 of the shank 1 the lower pawl 32 presents in the illustrated locking position and the slidable sleeve 3 is impossible to displace in relation to the shank 1, in turn, the end section 19 of said shank 1 is not extensible with respect to said cylinder 2, the spring 21 is thus continuously kept under the compressed state.

So called the umbrella "in the closing and preparative state before opening" means that the umbrella closing spring 43 is compressed when the user is preparing to open the umbrella, under this circumstance the user only needs to hold the grip 6 and to put the top end 24 of the cylinder 2 against any surface of the ground or a wall, then applies a slight force to cause the inner shaft 4 displaced in relation to the shank 1. Since the umbrella opening spring 21 has been already in the compressed state, so that the compression of the umbrella closing spring 43 can be easily accomplished by a light opeartion. At this time, the upper and lower holes 41 and 42 of the inner shaft 4 are aligned with the upper lower holder 12 and 13, respectively. So that the upper and lower locking means 73 and 77 are both in locking positions, in which the upper locking means 74 is also locked into the recess 47 of the slide block 45. Owing to the locking action made by the lower locking means 77, the inner shaft 4 is no longer possible to displace with respect to the shank 1, so that the umbrella closing spring 43 is kept under compressed, energy accumulated state, as illustrated in FIG. 1.

In the preparative state before opening of the umbrella, due to the fact that the upper locking means 73 is also locked into the upper hole 12 of the shank 1 and the aligned upper hole 41 of the inner shaft 4, so that a safety is secured to prevent the push button 71 from driving downwards. Therefore, the umbrella closing spring 43 is continousely kept under compressed state before the opening action of the umbrella is finished, so as to avoid the risk that said spring 43 would be expanded due to a false operation to drive the push putton downwards.

In operation, when the automatic umbrella of the invention is in the closing and preparative state before opening as shown in FIG. 1, both springs 21 and 43 are all in compressed state. When the push button 71 is lightly driven upwards, the actuator 72 in turn drives the upper locking means 73 upwards accordingly. The upper locking means 73 pushes the slide block 45 upwards due to the fact that said means 73 is locked into the recess 47, until the slide block 45 abutts the step 441 in deflection of the wire 44 and thus drives the wire 44 upwards. The wire 44 simultaneously pulls up the inner sleeve 34, then the lower edge of the slot 35 will push the lower pawl 32 out of the lower aperture 15 to become disengaged state. Thereby, the umbrella opening spring 21 is started to expand, this causes the middle ring 18 moved downwards and the lower ring 33 along with the slidable sleeve 3 moved upwards. Meanwhile, the wire 44 is continuousely pulled up until the hook 442 touches the lower end of the block 45, and all together move upwards, until the recess 47 leaves the upper locking means 73 to release the locked state. The slidable sleeve 3 is displaced upwards until the slot 35 of the inner sleeve 34 is aligned with the upper aperture 14, the upper pawl 31 is engaged into said upper aperture 14 to become fixed state. Accompanying with the movements of the middle ring 18 and the lower ring 33, the frame of the umbrella including the ribs 81, the spreaders 82 and the supports 83 is now fully opened, as shown in FIG. 3.

Figures 3, 4:
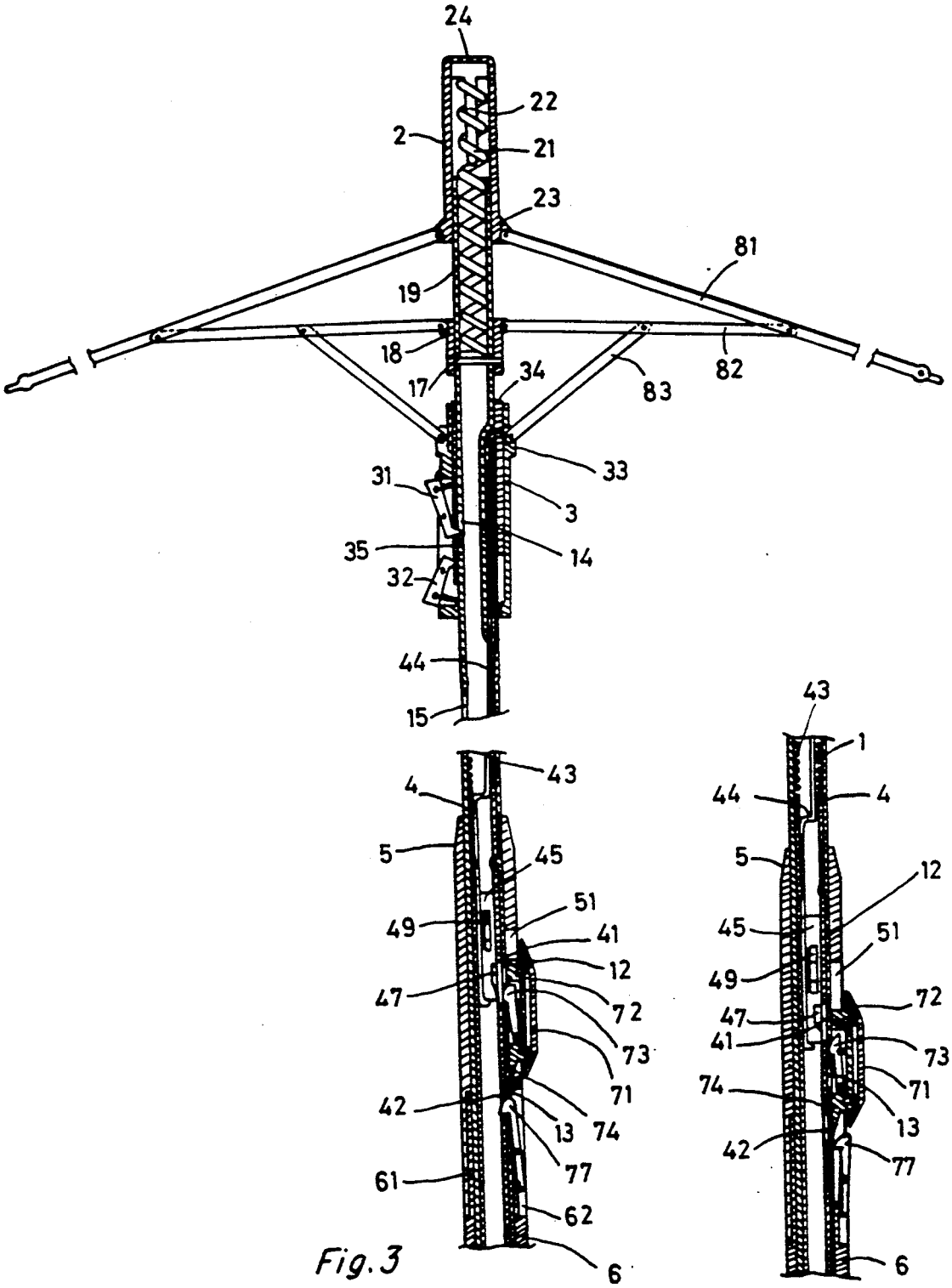
FIG. 3 is a party sectional elevation illustrating the umbrella in the opening state.
FIG. 4 is a fragmentary sectional elevation illustrating the actuating member in the closing state.

When the opened umbrella is going to be closed, the push button 71 is driven downwards, then the taper portion 74 of the actuator 72 pushes the lower locking means 77 out of the lower hole 42 of the inner shaft 4 and the lower hole 13 of the shank 1, as shown in FIG. 4. The compressed spring 43 is now expanded. Since the grip 6 is hold by hand (not shown) so that the shank 1 is pushed upwards by means of the expansion force of the umbrella closing spring 43, to compress the opening spring 21 and to pull down the slidable sleeve 3 relatively. The upper pawl 31 is pushed away from the upper aperture 14 by the upper edge of the slot 35 of the inner sleeve 34 to become disengaged state. The middle ring 18 is moved upwards to an extent to abut the upper ring 23 while the lower ring 23 is moved along with the slidable sleeve 3 downwards. Accompanying with the movements of said middle and lower rings 18 and 33, the frame of the umbrella including the ribs 81, the spreaders 82 and the supports 83 is now fully closed.

As mentioned above, the arrangement and construction of the automatic umbrella according to the present invention are lightly opearable. Moreover, the corresponding springs 21 and 43 are ready in a compressed, energy accumulated state before opening or closing the umbrella, so that the operation is made fast and positive.

Although the invention has been described in detail with reference to its presently preferred embodiment, it will be understood by one skilled in the art that various modifications, changes and variations can be made without departing from the spirit and scope of the invention.

What I claim is:

1. A lightly operable fully automatic umbrella comprising, in combination:

a hollow shank having a reduced neck at intermediate portion to divide it into an upper section having upper and lower apertures and a lower section having upper and lower holes, a longitudinal guide groove at said upper section and a middle ring provided at a location having a distance from the top end, said guide groove having a through hole communicating with the interior of said shank;

a cylinder mounted around said shank at the end section above said middle ring for receiving an umbrella opening spring therein, and provided with an upper ring at outer lower end;

a slidable sleeve mounted around said shank at said upper section, having upper and lower pawls, and provided with a lower ring at outer upper end, including an inner sleeve having a slot;

an inner shaft inserted in said lower section of said shank, having upper and lower holes, including an umbrella closing spring received in a space between the top end thereof and said reduced neck, a wire and a slide block, the upper end of said wire extending out of said through hole in said guide groove of said shank and hooking onto said inner sleeve;

a handle with a grip, mounted outside of said lower section of said shank; and an actuating member disposed at lateral side of said handle, having upper and lower locking means for controlling the action of opening and closing the umbrella, respectively.

2. A fully automatic umbrella according to claim 1, wherein said umbrella opening spring is continuously kept under compressed state when the umbrella is closed while said umbrella closing spring is also continuously kept under compressed state when the umbrella is opened.

3. A fully automatic umbrella according to claim 1, wherein said actuating member comprises a push button and an actuator, said actuator has a taper portion at lower end, said upper locking means is disposed under said actuator and said lower locking means is disposed below said taper portion and actuated thereby.

4. A fully automatic umbrella according to claim 3, wherein said actuator includes a return spring which makes said actuator returned to intermediate position after it is either pushed upwards to act on said upper locking means or downwards to act on said lower locking means.

5. A fully automatic umbrella according to claim 1, wherein said inner sleeve of said slidable sleeve is displaceable in relation to said shank between the position that said slot of said inner sleeve is respectively aligned with said upper and lower apertures, when said slot is aligned with said upper aperture, said upper pawl is engaged thereinto to keep the opened state of the umbrella whereas said slot is aligned with said lower aperture, said lower pawl is engaged thereinto to keep the closed state of the umbrella.

6. A fully automatic umbrella according to claim 1, wherein when said umbrella closing spring is under compressed state and before said actuator is operated to open the umbrella, said upper locking means is in a safe state to prevent said actuator from any action to act on said lower locking means in closing the umbrella.

* * * * *